US005173199A

United States Patent [19]

Brückner et al.

[11] Patent Number: 5,173,199

[45] Date of Patent: Dec. 22, 1992

[54] APPARATUS FOR USE IN REPLACING A WORN POURING PIPE AND FOR ADJUSTING MOLTEN METAL FLOW THROUGH A POURING PIPE

[75] Inventors: Raimund Brückner, Engenhahn-Niedernhausen; Ernst Lührsen, Bad Schwalbach; Hans Rothfuss, Taunusstein; Ullrich Hintzen, Taunesstein-Watzhahn; Peter Keutgen, Kreuzau, all of Fed. Rep. of Germany

[73] Assignee: Didier-Werke AG, Wiesbaden, Fed. Rep. of Germany

[21] Appl. No.: 735,244

[22] Filed: Jul. 24, 1991

[30] Foreign Application Priority Data

Jul. 24, 1990 [DE] Fed. Rep. of Germany ..... 4023484

[51] Int. Cl.[5] ..... B22D 41/56

[52] U.S. Cl. ..... 222/600; 222/606

[58] Field of Search ..... 266/236; 222/597, 600, 222/606, 607, 594

[56] References Cited

U.S. PATENT DOCUMENTS 4,220,271 9/1980 Szadkowski ..... 222/607

4,693,401 9/1987 Nishimura et al. ..... 222/607

FOREIGN PATENT DOCUMENTS

0192019A1 12/1985 European Pat. Off. .

2027881B2 12/1979 Fed. Rep. of Germany .

*Primary Examiner*—Scott Kastler

*Attorney, Agent, or Firm*—Wenderoth, Lind & Ponack

[57] ABSTRACT

An apparatus is disclosed for use in replacing a worn pouring pipe by moving a pouring pipe from a waiting position to a pouring position beneath a discharge opening of a metallurgical vessel, and for use in adjusting flow of molten metal from the metallurgical vessel through the discharge opening. For this purpose, slide rails are provided beneath the metallurgical vessel for supporting head plates of pouring pipe in the waiting position, the pouring position and a discharge position. Also, a linear actuator is provided for pushing the pouring pipe from the waiting position to the pouring position, and can be detachably coupled to the head plate of the pouring pipe so that it can move the pouring pipe in opposing direction to adjust the flow of molten metal through the discharge opening between zero flow and full flow. A base plate can be optionally provided between the metallurgical vessel and the head plates of the pouring pipe, and a second linear actuator can be provied for sliding the base plate relative to the discharge opening of the metallurgical vessel and/or relative to the head plate of the pouring pipe in the pouring position.

27 Claims, 8 Drawing Sheets

APPARATUS FOR USE IN REPLACING A WORN POURING PIPE AND FOR ADJUSTING MOLTEN METAL FLOW THROUGH A POURING PIPE

BACKGROUND OF THE INVENTION

1. Field of the Invention

The present invention relates, in general, to an apparatus for use in replacing a worn pouring pipe and for adjusting molten metal flow through a pouring pipe, and, more specifically, to an apparatus for use in moving a pouring pipe from a waiting position remote from a discharge opening of a metallurgical vessel into a pouring position wherein the pouring pipe is aligned with the discharge opening of the metallurgical vessel, and for adjusting the amount of molten metal flow through the discharge opening and pouring pipe in the pouring position.

2. Description of the Prior Art

In EP 0 192 019 A1, an apparatus is disclosed for replacing a worn pouring pipe by moving the head plate of a pouring pipe along guide rails from a waiting position in which the head plate is remote from a discharge opening of a metallurgical vessel, to a pouring position in which the pouring pipe is aligned with the discharge opening of the metallurgical vessel. When a pouring pipe in the pouring position is worn beyond certain limits, it can be moved along the guide rails from the pouring position into a discharge position by a simultaneous movement of a new pouring pipe from the waiting position into the pouring position. However, the pusher mechanism utilized for pushing the new pouring pipe from the waiting position to the pouring position is operable only to replace a worn pouring pipe, and is not operable to adjust the flow of molten metal through the discharge opening of the metallurgical vessel and through the pouring pipe.

In DE 20 27 881 B2, an apparatus is disclosed which provides the function of replacing a worn pouring pipe as in EP 0 192 019 A1, as well as the function of adjusting the flow of molten metal through the discharge opening of the metallurgical vessel. However, this apparatus requires two separate pusher mechanisms, one pusher mechanism to move the pouring pipe by small increments to adjust the flow of molten metal through the discharge opening of the metallurgical vessel, and a second pusher mechanism to move the first pusher mechanism and a slide plate into the pouring position In addition, this apparatus utilizes two such pairs of pusher mechanisms, one on either side of the pouring position

SUMMARY OF THE INVENTION

Accordingly, an object of the present invention is to provide an apparatus for both replacing a worn pouring pipe and also adjusting the flow of molten metal through a discharge opening of a metallurgical vessel.

A further object of the present invention is to provide both the replacement function and the adjustment function with the use of only a single pusher mechanism.

These objects are attained, according to the present invention, by providing an apparatus for moving a pouring pipe head plate or other refractory plate relative to a discharge opening of a metallurgical vessel, which comprises slide rail means for slidably supporting the refractory plate adjacent a bottom wall of the metallurgical vessel when the refractory plate is positioned in a pouring position adjacent the discharge opening of the metallurgical vessel, and a single first linear actuator comprising a drive means for moving the refractory plate from a waiting position, in which the refractory plate is remote from the discharge opening of the metallurgical vessel, to the pouring position, and for moving the refractory plate along the slide rail means to selectively vary the alignment of the refractory plate with the discharge opening so as to adjust flow of molten metal through the discharge opening. For this purpose, the linear actuator must be capable of affecting fine: adjustments to assure accurate positioning for flow adjustment. A coupling means is provided for detachably coupling the refractory plate to the first single linear actuator, and a biasing means is provided to urge the slide rail means upwardly toward the bottom wall of the metallurgical vessel.

A bottom plate is generally provided in abutment with the bottom wall of the metallurgical vessel with a through-hole aligned with the discharge opening of the metallurgical vessel. When the refractory plate is the head plate of the pouring pipe, it can be moved by the first linear actuator relative to the through-hole of the bottom plate and relative to the discharge opening of the metallurgical vessel. The slide rail means includes a plurality of discrete slide rail segments at the pouring position, as well as a pair of entry rails in the waiting position, and a pair of discharge rails in a discharge position on a side of the pouring position opposite the waiting position.

In a first embodiment of the present invention, the head plates of pouring pipes are supported by the slide rail means in direct abutment with a bottom face of the bottom plate. However, in a second embodiment of the invention, a slidable base plate having a through-hole formed therein can be arranged between the bottom plate and the head plates for slidable abutment with the bottom face of the bottom plate and slidable abutment with the top face of the head plates of the pouring pipes. This base plate can be moved, in the same direction as the pouring pipe or in a direction perpendicular thereto, independently of the head plates of the pouring pipes. To cause the slidable movement of the base plate relative to the bottom plate and the metallurgical vessel, a second linear actuator is provided and comprises a drive means for moving the base plate from a waiting position in which it is remote from the discharge opening of the metallurgical vessel to a pouring position in which the base plate is adjacent the discharge opening of the metallurgical vessel, and for moving the base plate along the slide rail means to vary alignment of the through-hole of the base plate with the discharge opening of the metallurgical vessel so as to adjust flow of molten metal through the discharge opening.

With the provision of the second linear actuator, a worn base plate can be replaced in a manner similar to the pouring pipes. In addition, the provision of the base plate and the second linear actuator allows molten metal flow to be adjusted by either of the first linear actuator and the pouring pipe head plate or the second linear actuator and the base plate.

In either of the first and second arrangements of the present invention, the flow of molten metal through the discharge opening of the metallurgical vessel can be adjusted between zero flow and full flow. In the first arrangement, this full range of adjustment is enabled due to the provision of an elongated portion on one side of the head plate of the pouring pipe, such portion being of sufficient size to completely cover the through-hole formed in the bottom plate, to thereby stop flow of molten metal through the discharge opening of the metallurgical vessel. In the second arrangement of the present invention, this full range of adjustment can be provided by either the elongated portion of the head plate of the pouring pipe or an elongated portion of the base plate which is also of sufficient size to completely block the through-hole of the bottom plate, to thereby stop the molten metal through the discharge opening of a metallurgical vessel. In addition, the head plate and the base plate can both be moved to cooperate in adjusting the flow.

BRIEF DESCRIPTION OF THE DRAWINGS

Additional features and advantages of the present invention will become apparent upon reading the following detailed description with reference to the accompanying drawing figures, in which.

DETAILED DESCRIPTION OF THE INVENTION

A first embodiment of the present invention is shown in FIGS. 1-5 and 10, and a second embodiment of the present invention is shown in FIGS. 6-9.

Figure 1:
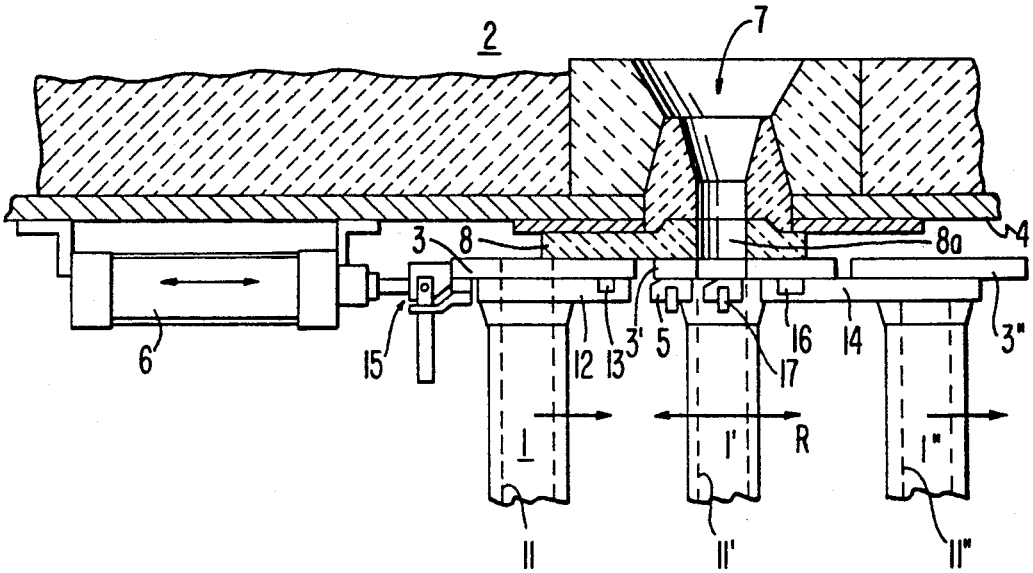
FIG. 1 is a front view, partially in cross section, of an apparatus according to a first embodiment of the present invention.

As shown in FIG. 1, a metallurgical vessel 2 having a bottom wall 4 is provided with a discharge opening 7 through which molten metal is adapted to flow. A pouring pipe 1' can be positioned beneath the discharge opening 7 of the metallurgical vessel 2 such that its flow channel 11' is aligned with the discharge opening 7 to allow molten metal to flow from the metallurgical vessel 2 through the flow channel 11' of the pouring pipe and into a mold (not shown). Slide rail means are provided for supporting head plates 3, 3', 3'' of pouring pipes 1, 1', 1''. In FIG. 1, a first pouring pipe 1 is shown having a head plate 3 supported on the slide rail means in a waiting position, a second pouring pipe 1' is shown having a head plate 3' supported on the slide rail means in a pouring position, and a third pouring pipe 1'' is shown having a head plate 3'' supported on the slide rail means in a discharge position.

A first linear actuator (head plate drive means) 6 is mounted to the bottom wall 4 of the metallurgical vessel 2 and can be detachably coupled to the head plate 3 of pouring pipe 1 by way of a coupling mechanism 15. Although the first linear actuator can be any suitable linear actuator, such as a linear actuable solenoid, or even a rotary motor with a rotary-to-linear linkage, it is preferred that the first linear actuator 6 be formed by a piston/cylinder unit which can advantageously be either a pneumatic or hydraulic type piston/cylinder unit. The first linear actuator 6 is shown in FIG. 1 as being mounted to the bottom wall 4 of the metallurgical vessel by a pair of L-shaped brackets. However, the first linear actuator 6 can, of course, be mounted to the bottom wall 4 by any suitable means. As schematically illustrated by a double arrow in FIG. 1, the linear actuator is a double-action linear actuator, such that, when coupled to the head plate 3 of the pouring pipe 1, it can cause reciprocating movement of the pouring pipe in the longitudinal direction along the guide rail means, as indicated by both single and double arrows in FIG. 1.

Advantageously, a bottom plate 8 having a through-hole **8*a* formed therein is mounted in fixed position relative to the metallurgical vessel 2 such that its upper face abuts against the lower face of the metallurgical vessel 2, and its lower face abuts against the upper face of the head plate 3 of the pouring pipe 1. The bottom plate 8 is preferably formed of a refractory material, such as a ceramic material or the like, and is an interchangeable element, such that upon becoming worn or eroded due to the flow of molten metal through the through-hole 8*a*, the worn or eroded bottom plate 8** can be discarded and replaced by a new bottom plate.

Figure 3:
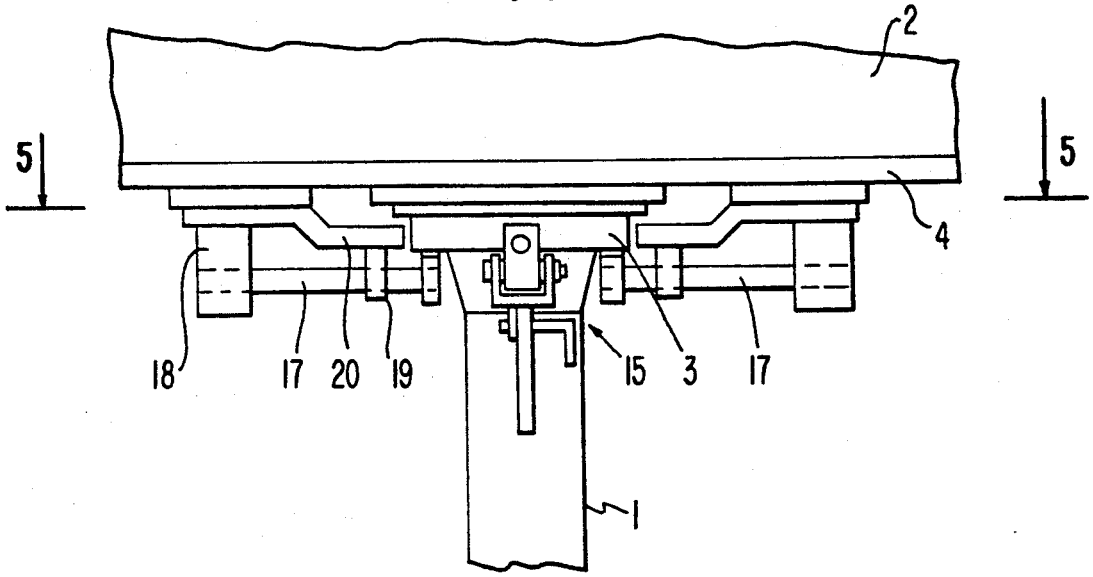
FIG. 3 is a side view of the apparatus according to the first embodiment of the present invention.

Similarly, the pouring pipe 1, including the head plate 3 thereof, is formed of a refractory material, such as a ceramic material or the like. The present invention allows a worn or eroded pouring pipe 1' in the pouring position to be replaced by a new pouring pipe 1 by moving the pouring pipe 1 from the waiting position to the pouring position. Also, as best shown in FIG. 3, for safety reasons, the head plate 3 is formed integrally with the pouring pipe 1.

As stated above, the head plate 3 of the pouring pipe 1 is supported against the bottom face of the bottom plate 8 by a slide rail means. This slide rail means is formed, in the waiting position of the pouring pipe 1, by a pair of entry rails 12, 12' (see FIGS. 1 and 5). In the pouring position of the pouring pipe 1', the slide rail means is formed by a plurality of contact strips or slide rail segments 5, each of which preferably includes a sloped portion at the entry side thereof to aid in the movement of the head plate 3 thereonto, and some of which are preferably spring biased upwardly toward the metallurgical vessel 2. In the discharge position of the pouring pipe 1'', the slide rail means is formed by a pair of discharge rails 14 which are preferably sloped slightly downwardly away from the pouring position.

Figure 5:
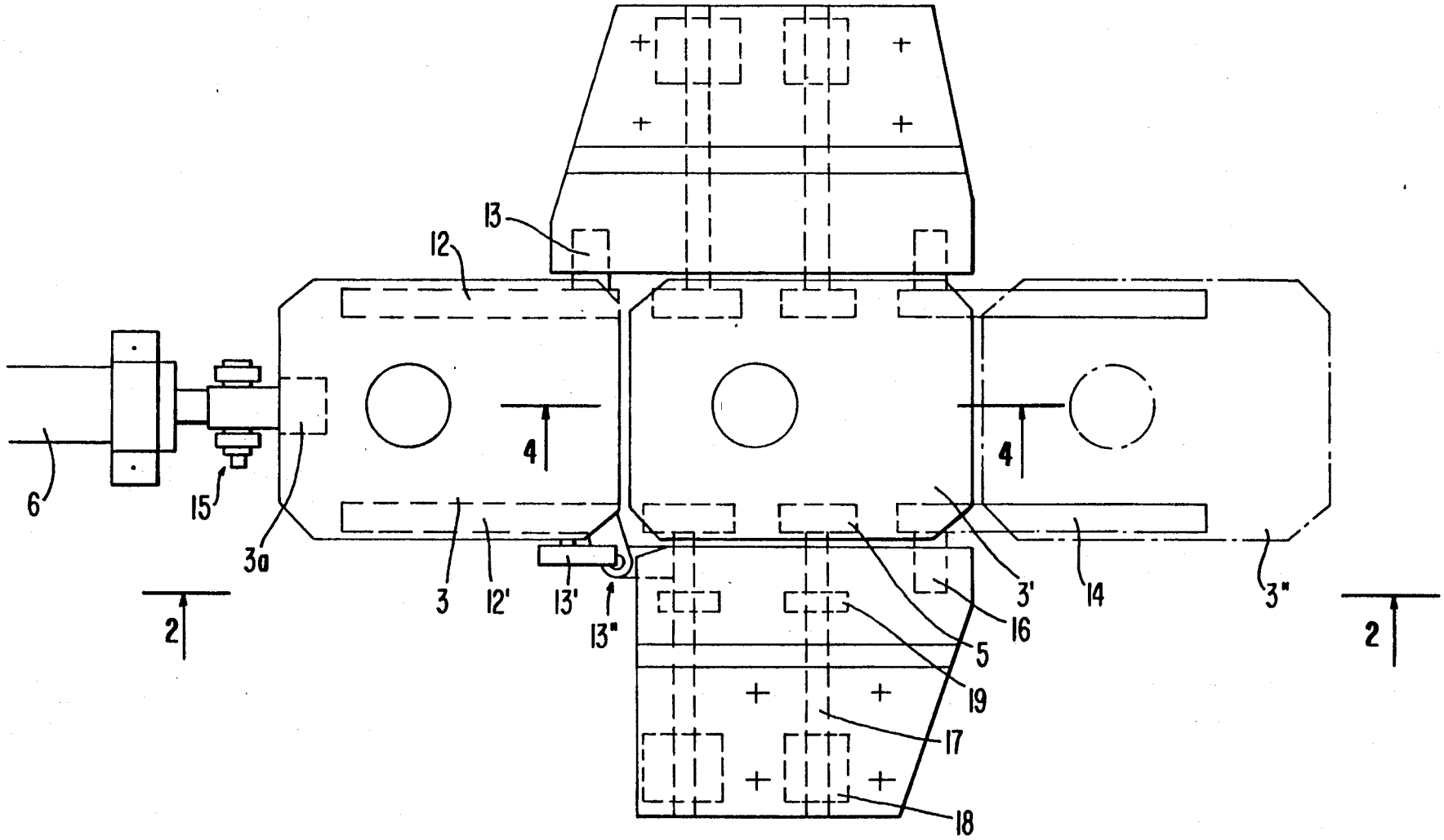
FIG. 5 is a plan view of the apparatus according to the first embodiment of the present invention taken along the line 6—6 of FIG. 4.

As best shown in FIG. 5, the entry rails 12, 12' are mounted to the bottom wall 4 of the metallurgical vessel by entry rail supports 13. In the preferred form of the first embodiment of the invention, one of the entry rails 12 is mounted in a fixed position relative to the metallurgical vessel 2, and the other of the entry rails 12' is pivotably mounted to the metallurgical vessel by an entry rail pivot support 13", such that it can swing along a plane parallel to the plane of the paper of FIG. 5.

The plurality of slide rail segments 5 preferably includes a pair of slide rail segments 5 arranged on each of the opposing sides of the discharge opening 7 of the metallurgical vessel 2. Each of these slide rail segments 5 is supported and biased upwardly by a spring member 17, which is preferably a spring bar or a leaf spring. The spring members 17 are respectively supported by spring member end supports 18 and spring member mid supports 19 which are mounted to spring member mounting arms 20, which are, in turn, fixed to the bottom wall 4 of the metallurgical vessel 2. In addition, it is contemplated that the slide rail segments can be made vertically adjustable relative to one another. At the discharge position of the pouring pipe 1", the discharge rails 14 are supported on opposing sides of the discharge opening 7 by discharge rail supports 16, as best shown in FIGS. 1 and 5.

Figure 4:
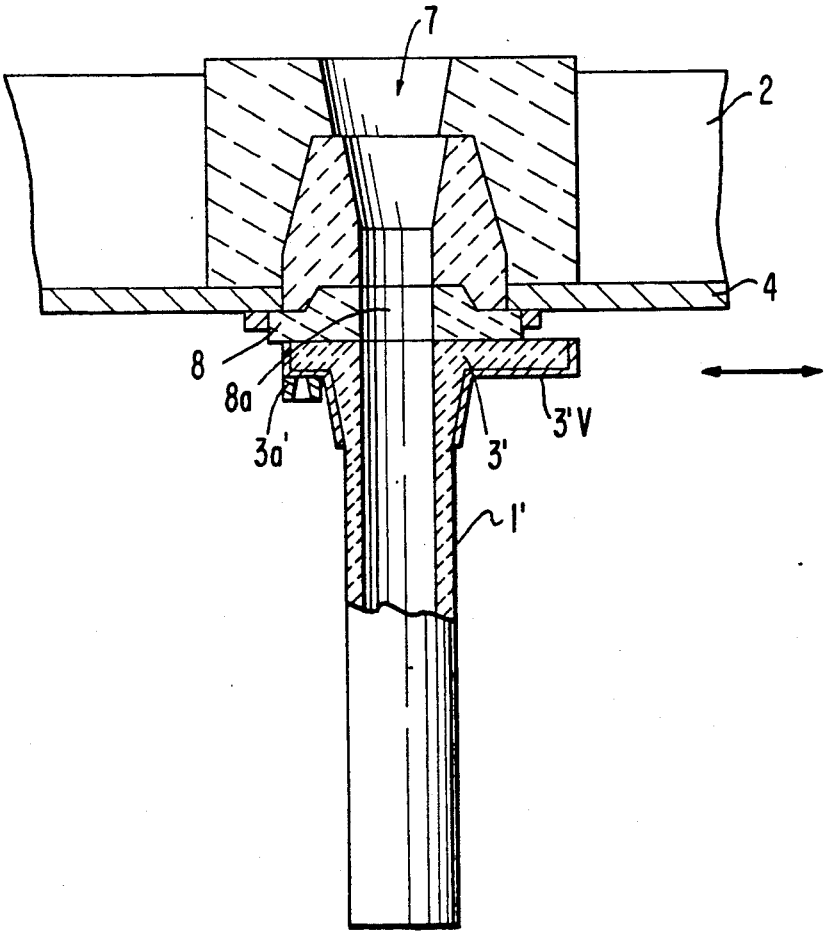
FIG. 4 is a cross sectional view of the apparatus according to the first embodiment of the present invention taken along the line 4—4 of FIG. 5.

According to this invention, the head plate 3' of the pouring pipe 1' includes an elongated portion 3'*v* as shown in FIG. 4. This elongated portion 3'*v* acts as a shut off valve (or blocking portion) when positioned directly beneath the discharge opening 7, and operates as a control valve to control flow of molten metal through the discharge opening 7 of the metallurgical vessel 2 when it is positioned only partly beneath the discharge opening 7 such that the flow channel 11' of the pouring pipe 1' is only somewhat misaligned relative to the discharge opening 7. In addition, the head plate 3' of the pouring pipe 1' is provided with a female coupling part 3'*a* to allow for connection of the linear actuator 6 with the head plate 3' by way of the coupling mechanism 15. In the preferred arrangement shown in the drawing figures, the elongated portion 3'*v* of the head plate 3' of the pouring pipe 1' is formed on the right side of the head plate 3' as viewed in FIGS. 1, 2 and 4, and the female connecting part 3'*a* is formed on the left side of the head plate 3' of the pouring pipe 1' as viewed in FIGS. 1, 2 and 4. However, the elongated portion 3'*v* and the female coupling part 3'*a* can be formed on the head plate in any suitable position or arrangement.

Figure 2:
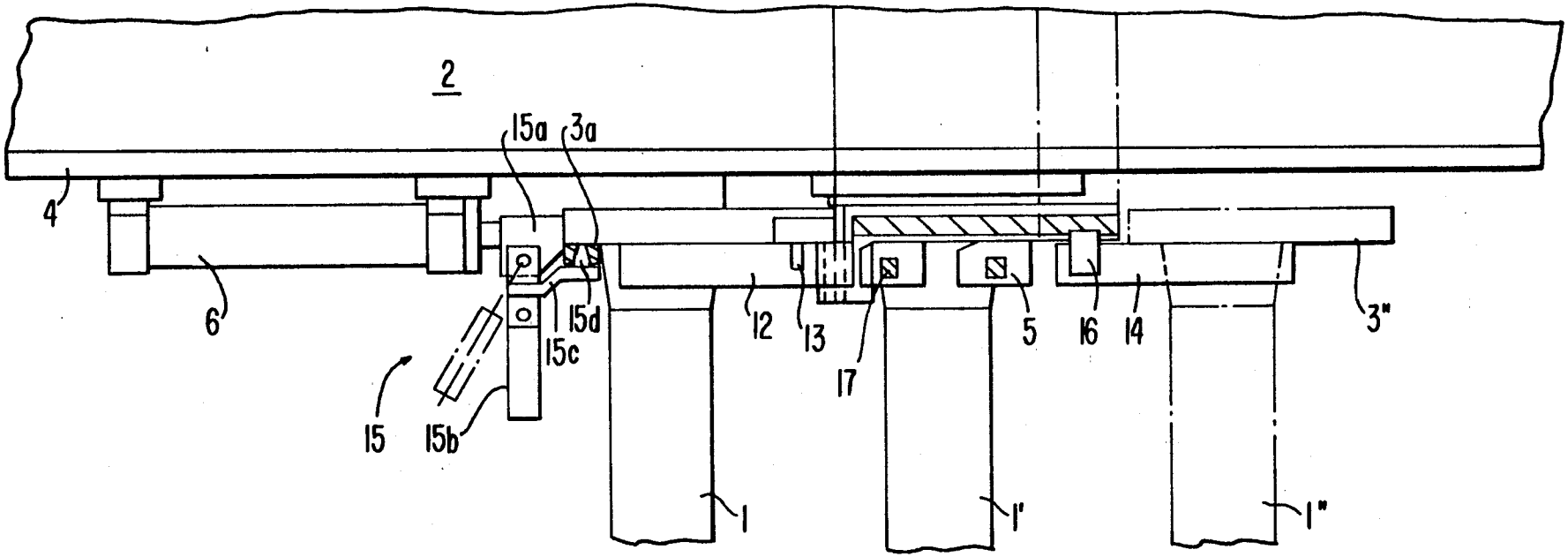
FIG. 2 is a cross sectional view of an apparatus according to the first embodiment of the present invention taken along the line 2—2 of FIG. 5.

As shown best in FIG. 2, the coupling mechanism 15 is fixed to the piston rod of the linear actuator 6 and is detachably engageable with the female connecting part 3*a*. The coupling mechanism 15 includes a coupling head 15*a* which is fixed to the piston rod of the linear actuator 6 and which is abutable against the left edge (as viewed in FIG. 2) of the head plate 3. A coupling lever 15*b* is pivotably suspended from the coupling head 15*a*, and a male coupling arm 15*c* having a male coupling pin 15*d* mounted thereon is fixed to the coupling lever 15*b* and extends therefrom toward the right as viewed in FIG. 2. The male coupling pin 15*d* is preferably formed in a conical shape and is detachably engageable in a complementarily shaped conical recess formed in the female coupling part 3*a* of the head plate 3. The coupling lever 15*b* is pivotable between an engaging position shown in solid lines in FIG. 2 and the disengaging position shown in dashed lines in FIG. 2. Although the coupling pins 15*d* and the complementary recess in the coupling part 3*a* are conically shaped so as to allow proper engagement and disengagement of the pin 15*d* from the recess in the connecting part 3*a* taking into account the pivot arc of the coupling arm 15*c*, the pin 15*d* and the complementary recess of coupling part 3*a* can be formed in any suitable shape, so long as they are complementary to one another.

In operation of the first embodiment according to the invention, when the pouring pipe 1' becomes worn or eroded beyond certain limits, the new pouring pipe 1 in the waiting position is pushed into the pouring position by the linear actuator 6. When the new pouring pipe 1 is moved into the pouring position from the waiting position, the worn pouring pipe 1' is simultaneously forced rightwardly as viewed in FIG. 1 into the discharge position supported by the discharge rails 14. When the linear actuator 6 is coupled to the pouring pipe 1 by way of the coupling mechanism 15 and the female coupling part 3*a* of the head plate 3, and the pouring pipe 1 is moved into the pouring position, the linear actuator 6, which is a double-acting linear actuator, can be utilized to vary the alignment of the flow channel 11 of the pouring pipe 1 relative to the through-hole 8*a* of the bottom plate 8 and the discharge channel 7 of the metallurgical vessel 2, so as to adjust the amount of molten metal which is allowed to flow through the discharge opening 7. That is, the linear actuator 6 can be used to provide coarse movements of the pouring pipe 1 from the waiting position into the pouring position, and can then be used to provide fine adjustment of the positioning of the pouring pipe relative to the discharge opening 7. When the pouring pipe is properly located with its head plate 3' supported on the slide rail segments 5 and no further adjustment is desired, the linear actuator 6 can be uncoupled from the pouring pipe by pivoting the coupling lever 15*b* clockwise as viewed in FIG. 3 to cause the male coupling pin 15*d* of the coupling arm 15*c* to disengage from the recess formed in the female coupling part 3*a* of the head plate 3. The linear actuator can then be retracted to allow for movement of a new pouring pipe into the waiting position wherein it is ready to replace the pouring pipe 1' when it becomes unduly worn or eroded.

Figure 10:
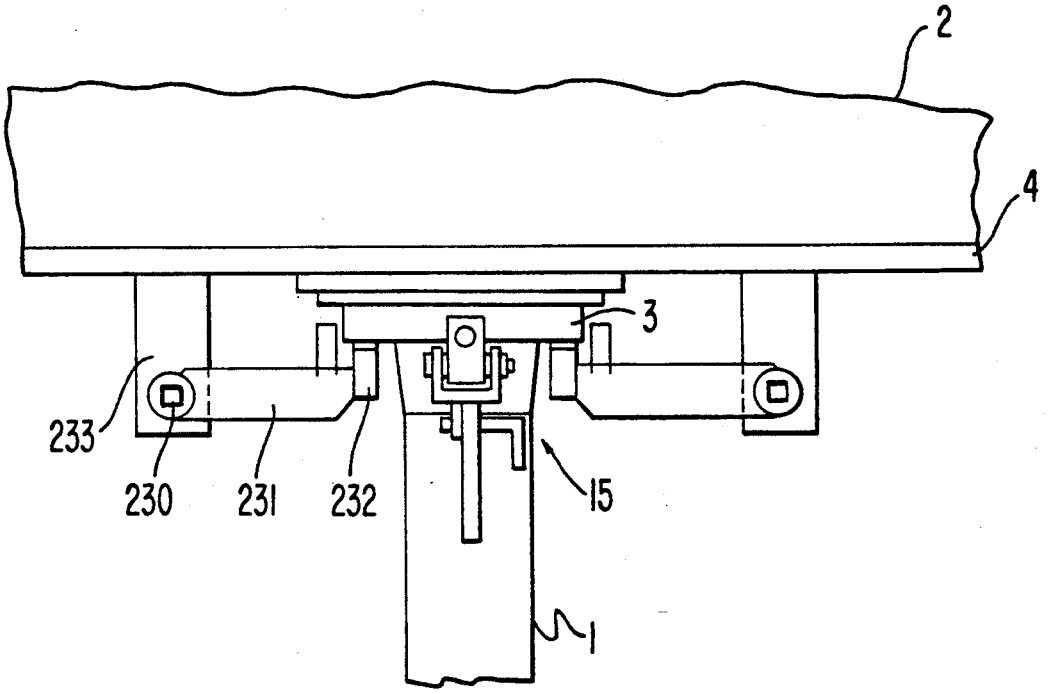
FIG. 10 is a side view, similar to that of FIG. 3, showing an alternative arrangement for the apparatus according to the first embodiment of the present invention.

In an alternative arrangement of the first embodiment, as shown in FIG. 10, the spring members 17 (see FIG. 3) are replaced by torsion arms 231 which are biased upwardly by torsion rods 230. At the inner ends of the respective torsion arms 231, slide rail segments or contact pieces 232 are fixed for supporting the head plates 3, 3', 3" of the pouring pipes, in a manner similar to that shown in FIG. 3. The torsion rods 230 are mounted to the bottom wall 4 of the metallurgical vessel 2 by torsion rod mounting members 233. For further illustration of this type of torsion arm arrangement, see FIGS. 7 and 8 which show a similar torsion arm arrangement (130–133) in connection with the second embodiment of the present invention, as described below.

Figure 6:
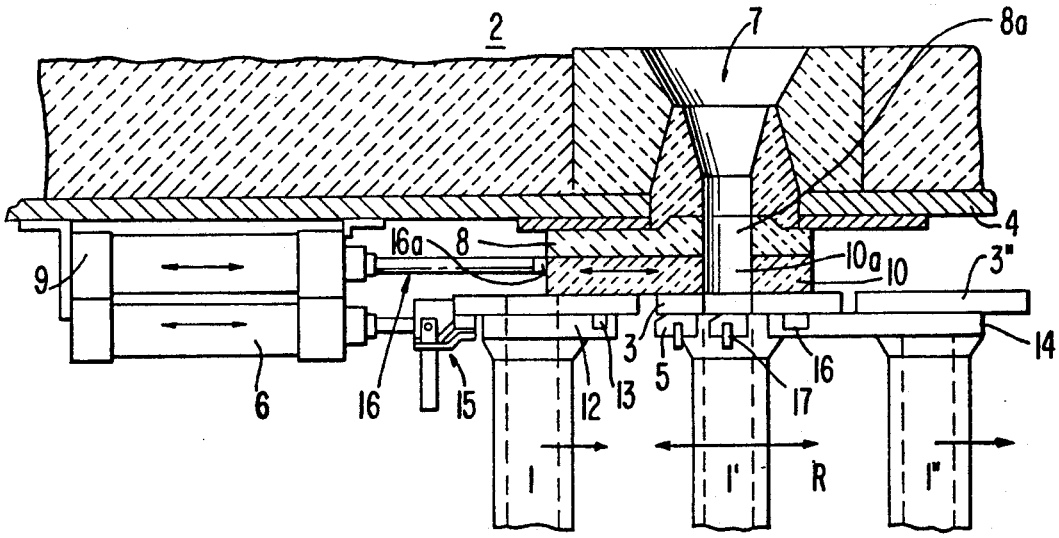
FIG. 6 is a partially cross sectional front view of an apparatus according to a second embodiment of the present invention.
Figure 7:
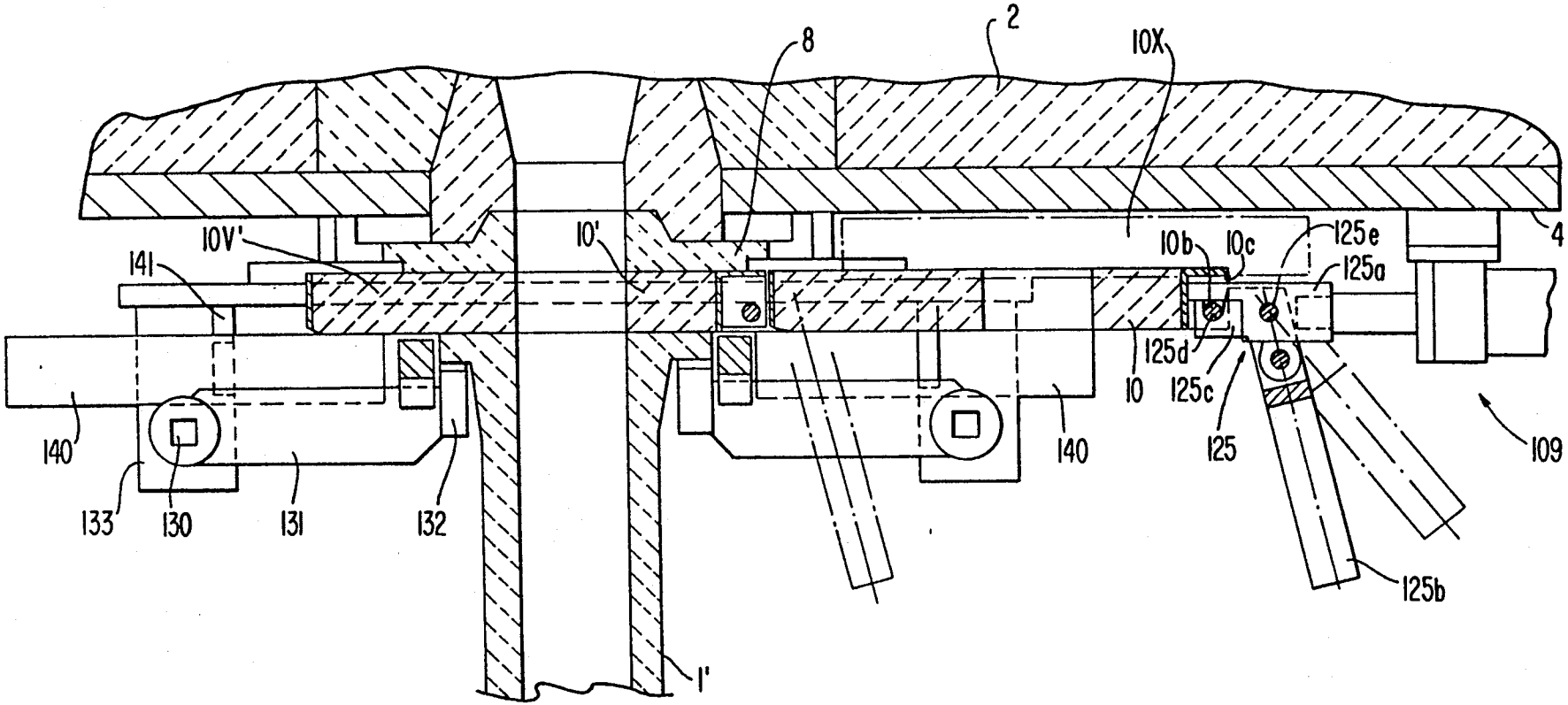
FIG. 7 is a cross sectional view of an apparatus according to an alternative arrangement of the second embodiment of the present invention taken along the line 7—7 of FIG. 9.
Figure 8:
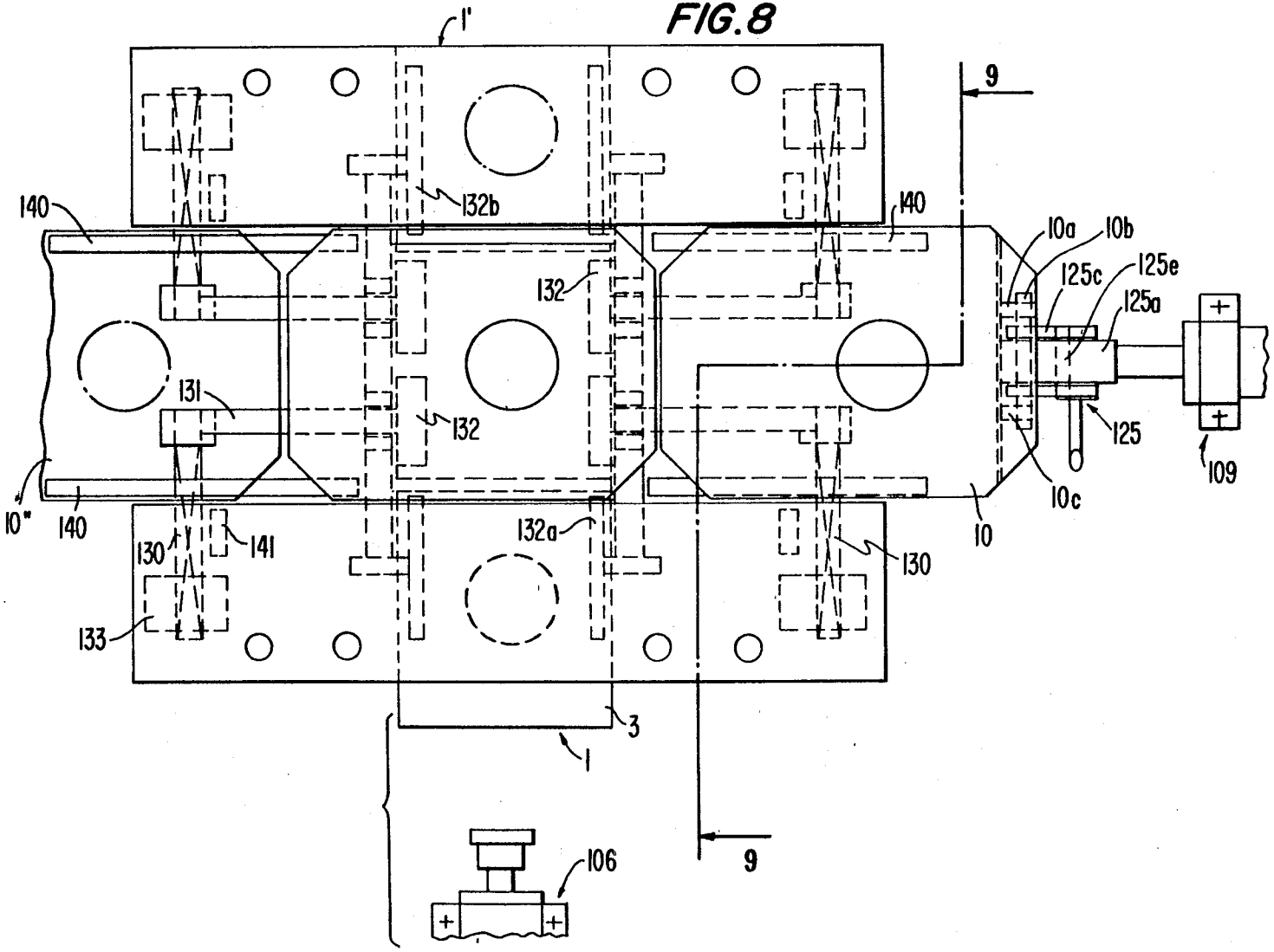
FIG. 8 is a cross sectional view of the apparatus shown in FIG. 7 taken along the line 8—8 of FIG. 9.
Figure 9:
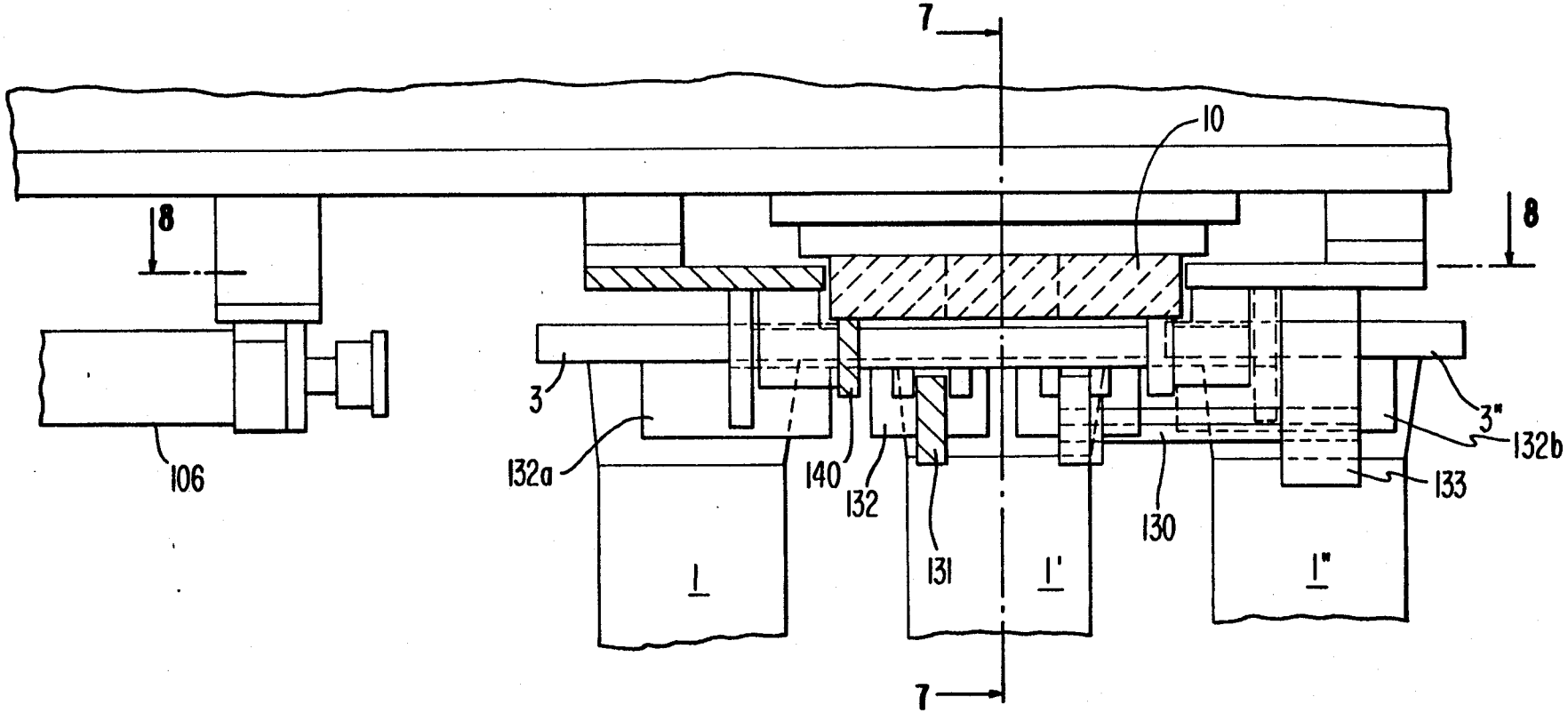
FIG. 9 is a cross sectional view of the apparatus shown in FIG. 7 taken along the line 9—9 of FIG. 8.

The second embodiment of the present invention is shown in FIGS. 6–9, wherein FIG. 6 shows a first arrangement of the second embodiment and FIGS. 7–9 show a second arrangement of the second embodiment. In general, the first arrangement of this second embodiment, as shown in FIG. 6, is similar to the apparatus of the first embodiment. Accordingly, like parts are designated by like reference numerals, and the description thereof will not be repeated. In this embodiment, however, a reciprocably slidable base plate (or refractory plate) 10 having a through-hole 10*a* is provided between the bottom plate 8 and the head plates 3, 3', 3" of the pouring pipes 1, 1', 1". In addition, a second linear actuator (base plate drive means) 9 is provided for slidably moving the base plate 10 relative to the bottom plate 8 and the metallurgical vessel 2 and/or relative to the head plate 3' of the pouring pipe 1'.

The second linear actuator 9 is preferably a piston/-cylinder unit operated by either pneumatic or hydraulic fluid. However, as with the first linear actuator 6, the second linear actuator 9 can be formed by any suitable drive means, such as a linear solenoid or a rotary motor with a rotary-to-linear linkage. In addition, as shown in FIG. 6, the second linear actuator 9 is preferably mounted to the bottom wall 4 of the metallurgical vessel 2 between the first linear actuator 6 and the bottom wall 4 by L-shaped brackets. However, in this second embodiment, the second linear actuator 9, as well as the first linear actuator 6, can be mounted to the metallurgical vessel 4, or for that matter to any suitable support, in any suitable manner or arrangement.

The second linear actuator 9 is connected to the base plate 10 by a second coupling mechanism 16, which is only schematically shown in FIG. 6. This second coupling mechanism 16 is schematically shown as including a detachment means 16*a* so that it can be detachably coupled with the base plate 10. Although the specific structure of the second coupling mechanism 16 is not shown, any suitable coupling mechanism can be used which is of a suitable size, shape and structural integrity to operate properly under the operating conditions present in the molding process. As with the bottom plate 8 and the pouring pipe 1, including the head plate 3, the base plate 10 is preferably formed of a refractory material, such as a ceramic material or the like. The provision of the base plate 10 and the second linear actuator 9 allows the flow of molten metal through the discharge opening 7 of the metallurgical vessel 2 to be controlled by not only the selective movement of the head plate 3' of the pouring pipe 1' relative to the discharge opening 7, but also by the selective movement of the base plate 10 relative to the discharge opening 7 and/or relative to the head plate 3'. This base plate 10 can be used to either supplement or selectively replace the flow control and flow shut-off functions of the head plate 3' of the pouring pipe 1'. In addition, the inclusion of the separate movable base plate 10 allows for a component in addition to the pouring pipe and the bottom plate to be selectively replaced when it becomes worn or eroded. Accordingly, a proper seal of the overall flow path of the molten metal, as defined by the discharge opening 7, the through-hole 8*a* of the bottom plate 8, the through-hole 10*a* of the base plate 10, and the flow channel 11' of the pouring pipe 1', can be assured due to the ability to replace any one of the bottom plate 8, the base plate 10 and the pouring pipe 1'. Although not specifically shown, it is clear that the base plate can be replaced in the same manner as the pouring pipe, as described above with respect to the first embodiment. That is, a base plate can be disposed in a waiting position and moved into a pouring position by the second linear actuator 9, whereby the base plate which had occupied the pouring position, will be pushed into the discharge position.

FIGS. 7–9 show the second arrangement of the second embodiment of the present invention. In this arrangement, like the first arrangement of the second embodiment, a first linear actuator (head plate drive means) 106 is provided for moving the head plates 3, 3', 3" of the pouring pipes 1, 1', 1" from a waiting position into a pouring position and finally to a discharge position, as well as a second linear actuator (base plate drive means) 109 for sliding base plates 10, 10', 10" from a waiting position into a pouring position and finally to a discharge position. In this arrangement, the first linear actuator 106 is not coupled to the head plates 3, 3', 3" and, as such, is adapted only to push the head plates, and thus the pouring pipes, along the slide rail means made up of entry rail segments 132*a*, slide rail segments or contact pieces 132, and discharge segments 132*b*. Furthermore, the second linear actuator 109 is detachably couplable to the base plates 10, 10', 10", by way of a coupling mechanism 125 (see FIGS. 7 and 8). The coupling mechanism 125 includes a coupling head 125*a* fixed to the end of the actuating rod of the linear actuator 109, and a coupling lever 125*b* which is pivotable about a pivot pin 125*e* between a coupling position (as shown in solid lines in FIG. 7) and an uncoupling position (as shown in phantom lines in FIG. 7). A coupling latch 125*c* is attached at the upper end of the coupling lever 125*b* and includes an upwardly opening U-shaped recess 125*d* which is adapted to engage with a latch pin 10*b* fixed to the base plate 10 when the coupling lever 125*b* is in its coupling position. The pin 10*b* is mounted to the base plate 10 by support flanges 10*c* which extend from a side of the base plate 10.

Due to the provision of this coupling mechanism 125 for detachably coupling the linear actuator 109 to the base plate 10, the base plate 10 can be reciprocably slid along base plate slide rails 140 which are mounted to the metallurgical vessel by slide rail mounting elements 141. The reference numeral 10*x* represents a space for inserting a new base plate. With this arrangement, the second linear actuator 109 can be used for replacing worn or eroded base plates (i.e. by pushing a base plate from the waiting position to the pouring position), and also for adjusting the positioning of the through-hole 10*a* of the base plate 10 relative to the discharge opening 7 of the metallurgical vessel 2 and/or relative to the flow channel 11 of the pouring pipe 1. Such positional adjustment enables the adjustment of the flow rate of molten metal from the discharge opening 7 of the metallurgical vessel 2, preferably between a full flow, when the through-hole 10*a* of the base plate 10 is perfectly aligned with the discharge opening 7 of the metallurgical vessel 2 and the flow channel 11 of the pouring pipe 1, and zero flow when the base plate completely blocks the discharge opening 7. In this regard, it is noted that as shown in FIG. 7, the base plate includes an elongated portion 10'V in the same manner as the head plate includes the elongated portion 3'V, to act as a shut off valve (or blocking portion).

As stated above, the first linear actuator 106 is effective to push the head plates of the pouring pipes along a slide rail means which includes slide rail segments 132. These slide rail segments 132 are pressed upwardly into contact against the bottom faces of the head plates by torsion arms 131 which are biased upwardly by torsion rods 130. The torsion rods are mounted to the bottom of the metallurgical vessel 2 by torsion rod mounting members 133. This arrangement results in both the pouring pipes and the base plates being biased upwardly into sealing abutment with the bottom plate 8 so as to provide for a reliable flow of molten metal without leakage thereof.

Although the present invention has been fully described with reference to the accompanying drawings, it is contemplated that many changes can be made that remain within the scope of the appended claims.

What is claimed is:

1. An apparatus for replacing a worn pouring pipe and for adjusting molten metal flow through the pouring pipe from a discharge opening in a bottom of a metallurgical vessel by moving the pouring pipe along with its head plate along guide rails from a waiting position remote from the discharge opening to a pouring position in which the pouring pipe and a through-hole of the head plate are aligned with the discharge opening, and, when worn beyond a certain limit, from the pouring position into a discharge position, said apparatus comprising:

a first single linear actuator comprising first drive means for moving the head plate from the waiting position to the pouring position and from the pouring position to the discharge position, and reciprocably moving the head plate and the pouring pipe along the guide rails to selectively vary alignment of the head plate with the discharge opening so as to adjust flow of molten metal through the discharge opening.

2. An apparatus as recited in claim 1, further comprising coupling means for detachably coupling the head plate to said first single linear actuator.

3. An apparatus as recited in claim 2, wherein said coupling means comprises a coupling head fixed to said first linear actuator, a coupling lever pivotably mounted to said coupling head, a coupling arm fixed to and extending from said coupling lever, and a coupling pin projecting upwardly from said coupling arm and adapted to engage with the head plate.

4. An apparatus as recited in claim 3, wherein said apparatus further includes the head plate, and said head plate includes a female coupling means for receiving said coupling pin of said coupling means.

5. An apparatus as recited in claim 1, wherein said apparatus is further operable for replacing a refractory plate and for adjusting molten metal flow through the pouring pipe from the discharge opening by moving the refractory plate along the bottom of the metallurgical vessel from a waiting position remote from the discharge opening to a pouring position in which a through hole of the refractory plate is aligned with the discharge opening and, when worn beyond a certain limit, from the pouring position into a discharge position, and said apparatus further comprises a second single linear actuator comprising second drive means for moving the refractory plate from the waiting position to the pouring position and from the pouring position to the discharge position, and for reciprocably moving the refractory plate along the bottom of the metallurgical vessel to selectively vary alignment of the refractory plate with the discharge opening so as to adjust flow of molten metal through the discharge opening.

6. An apparatus as recited in claim 5, wherein said first and second single linear actuators are operable to respectively slide the refractory plate and the head plate along the guide rails independently of one another.

7. An apparatus as recited in claim 5, further comprising coupling means for detachably coupling the refractory plate to said second linear actuator.

8. An apparatus as recited in claim 7, wherein said coupling means comprises a coupling head fixed to said second linear actuator, a coupling lever pivotably mounted to said coupling head, and a coupling latch fixed for movement with said coupling lever and having an upwardly opening recess formed therein.

9. An apparatus as recited in claim 8, wherein said apparatus further includes the refractory plate; and said refractory plate includes a plurality of support flanges at one end thereof and a latch pin, supported by said support flanges, for engaging in said recess of said coupling latch of said coupling means.

10. An apparatus as recited in claim 5, wherein said apparatus further includes the guide rails;

said guide rails define slide rail means for slidably supporting the head plate; and additional slide rail means are provided for slidably supporting the refractory plate for sliding movement relative to the sliding movement of the head plate.

11. An apparatus as recited in claim 10, wherein said additional slide rail means extend perpendicular relative to said slide rail means for supporting the refractory plate for sliding movement in a direction perpendicular to the direction of the sliding movement of the head plate.

12. An apparatus as recited in claim 10, wherein said additional slide rail means comprises a plurality of slide rail segments; and a biasing means is provided for biasing at least some of said slide rail segments upwardly so as to urge the head plate upwardly against the refractory plate and the refractory plate upwardly toward the bottom wall of the metallurgical vessel when the head plate and the refractory plate are in their pouring positions.

13. An apparatus as recited in claim 5, wherein said apparatus further includes the refractory plate; and said refractory plate has a through-hole formed therein offset from its center so as to define a solid elongated portion to one side of said refractory plate through-hole and an opposite portion, on a side of said refractory plate through-hole opposite said elongated portion, which is shorter than said elongated portion, such that said elongated portion defines a molten metal blocking portion for blocking flow of molten metal through the discharge opening of the metallurgical vessel.

14. An apparatus as recited in claim 13, wherein said refractory plate comprises a base plate adapted for abutment against a bottom face of a bottom plate and against a top face of the head plate of the pouring pipe; and a coupling means is mounted to said refractory plate for detachably positively coupling said refractory plate with said second single linear actuator.

15. An apparatus as recited in claim 14, wherein said coupling means comprises a pair of support flanges extending from one side of said refractory plate, and a latch pin mounted between said pair of support flanges, said latch pin being adapted for engagement in a recess of a coupling latch.

16. An apparatus as recited in claim 1, wherein said apparatus further includes the head plate having the through-hole formed therein; and said head plate through-hole is offset from a center of said head plate so as to define a solid elongated portion to one side of said head plate through-hole and an opposite portion, on a side of said head plate through-hole opposite said elongated portion, which is shorter than said elongated portion, such that said elongated portion defines a molten metal blocking portion for blocking flow of molten metal through the discharge opening of the metallurgical vessel.

17. An apparatus as recited in claim 16, wherein a coupling means is mounted to said head plate for detachably positively coupling said head plate with said first single linear actuator; and said coupling means comprises a female coupling part projecting downwardly from a bottom face of said head plate, and having a downwardly opening recess formed therein for receiving a coupling pin.

18. An apparatus as recited in claim 17, wherein said downwardly opening recess is conically shaped so as to receive a complementarily shaped conical coupling pin.

19. An apparatus as recited in claim 1, wherein said apparatus further includes the guide rails; and biasing means are provided for biasing at least a portion of said guide rails upwardly toward the bottom wall of the metallurgical vessel.

20. An apparatus as recited in claim 19, wherein said biasing means comprises a torsion arm with a first end connected to said guide rails, and a torsion rod connected to a second end of said torsion arm as so as to urge said first end of said torsion arm upwardly.

21. An apparatus as recited in claim 20, wherein said guide rails comprise a plurality of discrete slide rail segments.

22. An apparatus as recited in claim 1, wherein said apparatus further includes the guide rails;

said guide rails define slide rail means for slidably supporting the head plate; and said slide rail means comprises an entry slide rail for supporting the head plate in its waiting position, slide rail segments for supporting the head plate in its pouring position and a discharge slide rail for supporting the head plate in its discharge position.

23. An apparatus as recited in claim 1, wherein said apparatus further includes the guide rails;

said guide rails define slide rail means for slidably supporting the head plate; and said slide rail means comprises a plurality of discrete slide rail segments.

24. An apparatus as recited in claim 1, wherein said apparatus further includes the metallurgical vessel and the guide rails;

said guide rails define slide rail means for slidably supporting the head plate; and said slide rail means and said first linear actuator are mounted to and beneath said bottom wall of said metallurgical vessel.

25. An apparatus as recited in claim 24, further comprising a bottom plate, having a through-hole formed therein, mounted in abutment with said metallurgical vessel such that said through-hole of said bottom plate is aligned with said discharge opening of said metallurgical vessel.

26. An apparatus as recited in claim 25, wherein said apparatus further includes the pouring pipe and the head plate; and said head plate is supported on said slide rail means in abutment with a bottom face of said bottom plate.

27. An apparatus as recited in claim 26, further comprising a base plate supported atop said head plate when in a pouring position, said base plate having a through-hole therein which is alignable with said discharge opening of said metallurgical vessel and with said through-hole of said head plate.

* * * * *